US006089842A

United States Patent [19]

Dehmel et al.

[11] Patent Number: 6,089,842

[45] Date of Patent: Jul. 18, 2000

[54] GEAR OIL PUMP WITH INTERNAL ROTOR, COMPRISING EXTENSIONS OF RENIFORM SUCTION AND PRESSURE ELEMENTS

[75] Inventors: Harald Dehmel; Robert Laux; Bernd Schreiber; Gunther Stutzle, all of Bad Schussenried, Germany

[73] Assignee: Schwabische Huttenwerke GmbH, Germany

[21] Appl. No.: 09/125,291

[22] PCT Filed: Dec. 16, 1997

[86] PCT No.: PCT/DE97/02931

§ 371 Date: Apr. 2, 1999

§ 102(e) Date: Apr. 2, 1999

[87] PCT Pub. No.: WO98/27339

PCT Pub. Date: Jun. 25, 1998

[30] Foreign Application Priority Data

Dec. 16, 1996 [DE] Germany ..... 196 51 950
Oct. 29, 1997 [DE] Germany ..... 197 47 786

[51] Int. Cl.[7] ..... F04C 2/10
[52] U.S. Cl. ..... 418/171
[58] Field of Search ..... 418/15, 166, 170, 418/171

[56] References Cited

U.S. PATENT DOCUMENTS 3,016,834 1/1962 Deska et al. ..... 418/171
5,249,942 10/1993 Torii et al. ..... 418/171

*Primary Examiner*—John J. Vrablik
*Attorney, Agent, or Firm*—Fish & Richardson, P.C.

[57] ABSTRACT

A gear pump with internal rotors for pumping fluids includes one or more internal gear rotors, a cover, at least one infeed reniform suction chamber in a pump housing, at least one discharge reniform pressure chamber in the pump housing, and a reniform pressure chamber extension. Each gear rotor has teeth, is located in the pump housing, and is driven by a central shaft. The cover seals the pump housing and is adjacent to the one or more internal gear rotors. Each infeed reniform suction chamber has a first end and a second end, and at least partially covers end areas of the teeth. Each discharge reniform pressure chamber has a first end and a second end, and at least partially covers the end areas of the teeth. The reniform pressure chamber extension has a first end and a second end and is located in the cover opposite the discharge reniform pressure chamber. The first end of the discharge reniform pressure chamber is substantially adjacent to the first end of the reniform pressure chamber extension. A radial distance between the first and second ends of the reniform pressure chamber extension is less than a radial distance between the first and second ends of the discharge reniform pressure chamber. The reniform pressure chamber extension covers the teeth to a lesser extent than does the discharge reniform pressure chamber.

18 Claims, 5 Drawing Sheets

GEAR OIL PUMP WITH INTERNAL ROTOR, COMPRISING EXTENSIONS OF RENIFORM SUCTION AND PRESSURE ELEMENTS

TECHNICAL FIELD

This invention relates to a gear pump with internal rotor for pumping fluids, such as oil, in gear boxes, pumps, and internal combustion engines.

BACKGROUND

Gear pump with internal rotors are being used more and more as oil pumps and for filling gearboxes or other pumps, on the one hand, and to lubricate internal combustion engine, on the other hand. In all cases, the requirements, in part, consist of producing the most uniform possible pulse-free delivered stream, minimizing the effects of cavitation in the pump, and reducing the noise accompanying cavitation and pulsation. This invention is intended to improve gear pumps with internal rotors for oil delivery in line with these requirements.

The oil to be delivered is fed to known pumps through a suction channel running in the pump housing as tangentially as possible essentially at the meshing point of the gears between inner and outer rotors in a reniform suction chamber, also know as a reniform suction element transported between the teeth of the two rotor, and fed out of the housing through a pressure channel as tangentially as possible to the points of use by a reniform pressure chamber, also know, as a reniform pressure element. In the known designs, the suction and pressure channels are located only on one side, usually for space reasons of the housing side of the pair of gears, while the side of the housing ending in the transport chamber, usually the cover, has a smooth surface on the inside of the pump. The stream of oil thus enters the transport chamber at one side of the pair of gear rotors and leaves it on the same side. Such a pump is described, for example, in DE-PS 3410015 or EP-PS 0161421. Gear pumps for oil with internal rotors of the type described often reach a state of cavitation at high speeds. Since the transport chambers between the teeth of the pair of rotors are no longer completely filled at very high rotational speeds, air is dissolved in the transported oil at reduced pressure and oil vapor is formed. The gases implode with increasing pressure on the pressure side, with the noise level, the pressure pulsation, and the power consumption rising. In particularly negative cases, pump parts may be mechanically attacked by these implosions and even destroyed. Attempts to obviate these incidents in the past have been limited to changing the contours, particularly those of the reniform infeed channel, i.e., to lengthen or shorten it, anal also, for example, to split it into two sub-kidneys at its end. However, the result of these efforts so far has not been satisfactory. Benefits achieved produced drawbacks elsewhere.

The invention modifies the spaces available in the pump for suction and pressure by placing additional reniform chambers at the side opposite the inflow and outflow, usually in the cover, which essentially correspond to the reniform suction and pressure chambers but differ from them in part, particularly in their radial extent.

Such designs are likewise already known in principle to the extent of additional opposing reniform chambers being positioned opposite the inflow and outflow side, for example from DE OS 2 249 395, DE PS 35 06 920 C2, or DE OS 29 34 002 A1. All of the designs of this type disclosed so far, however, pursue the objective only of bringing the fluid to be transported also to the opposite side of the pair of rotors in order to have the lateral pressure which is acting the pair of rotors, act on both sides and thus to prevent the rotors from running into a wall of the housing with the resultant harmful consequences on power and pump wear. Thus, the problem focused an in these prior publications is not to improve the filling of cavities between the teeth and to reduce cavitation by different reniform chambers designs on the inflow/outflow side on the one hand and the opposite side on the other. In the same way, there are no differing reniform chambers designs deduced from them.

SUMMARY

In the design pursuant to the invention, the reniform such chambers have essentially identical designs on both sides of the pair of rotors, but the reniform pressure chambers on the side opposite the outflow side is set back from the end of the reniform chambers in the delivery direction. The spacing on the inflow/outflow side is preferably large enough for one tooth of the pair of rotors to be covered with no reniform chambers, while the spacing on the opposite side is 1.5 to 2 teeth of the pair of rotor. The oil flowing into the transport chambers in this way has the ability with increasing buildup of transport pressure partly to overflow into the additional reniform chamber, which also achieves complete filling of the teeth interstices in the area in which the reniform chambers is present on one side only. The size of the coverage on the side opposite the inflow/outflow suitably depends on the speed of rotation at which the pump is to operate, which is selected to be higher or lower. Surprisingly it has been found that a substantial reduction of cavitation and thus of the disturbing noise and pulsation can be achieved by the relatively simple additional design of the pump housing with reniform chambers of different sizes on the two sides.

Since the reniform chambers on the side opposite the inflow/outflow have no direct connection to the inflow or outflow channels, they can also be put in position when this side is the cover side of the pump. (Specifically, because only limited space is available in various pump arrangements, the pump cover can usually not be widened, and therefore does not permit the positioning of inflow or outflow channels). The pump pursuant to the invention can thus also he used as a replacement for existing pump designs without the need or making changes in the surroundings of the pump. This is especially important, for example, when using the pumps as lubricating oil pumps for internal combustion engines in motor vehicles, where design changes of the internal combustion engines arm prohibitive because of the high expense associated with them.

In a simplified embodiment, which is especially suitable for pumps that run at lower speeds, the double arrangement of the reniform suction chambers can be dispensed with. The invention will be described below by way example in FIGS. 1 to 5.

DESCRIPTION

Figures 1, 2:
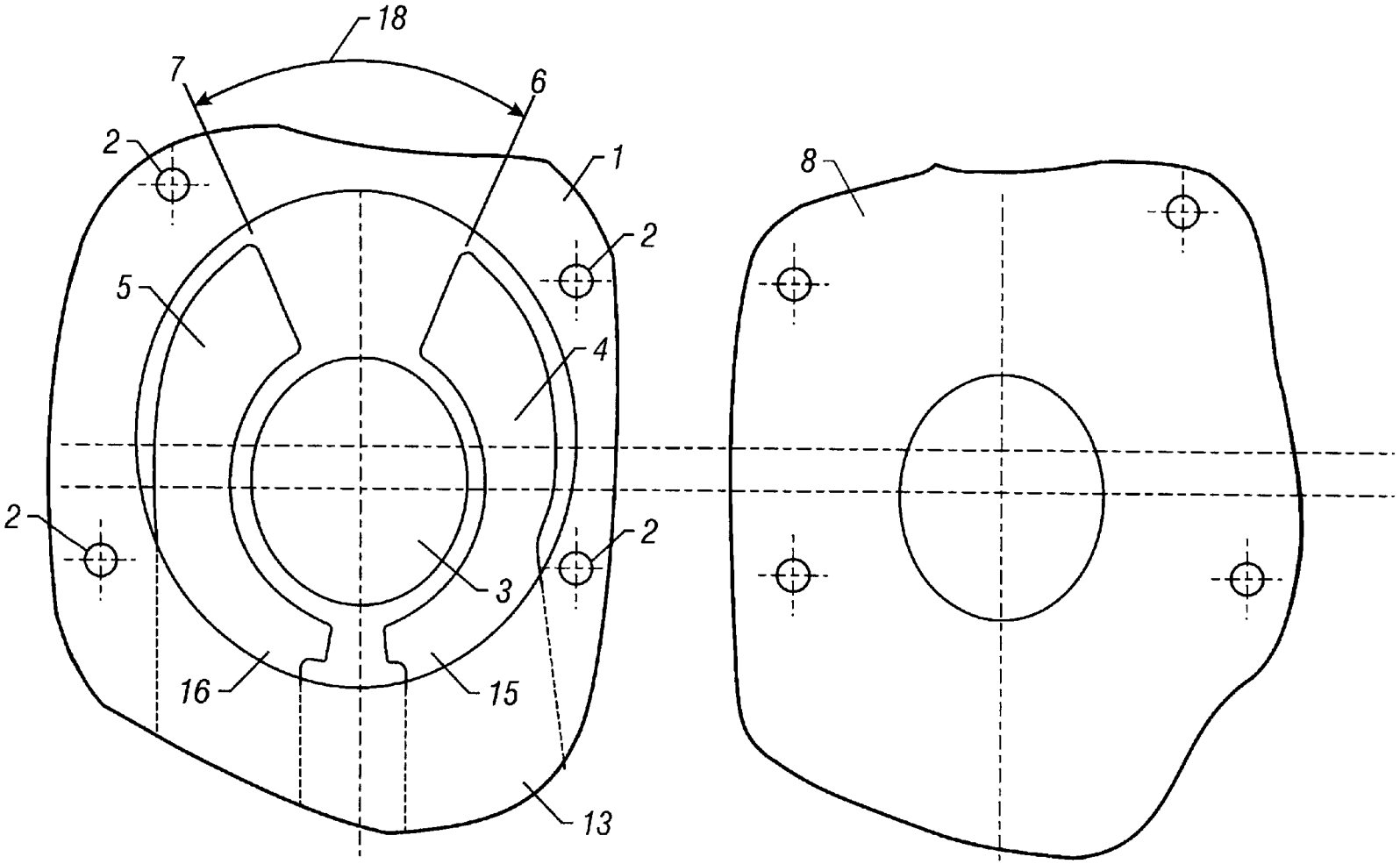
FIG. 2 (Prior Art)
FIG. 1 (Prior Art)
FIGS. 1 and 2 illustrate the housing and cover of a pump with no reniform chambers extension in top view.

FIG. 1 shows a top view of pump housing 1 with holes 2 for fastening screws and a central hole 3 for the drive shaft. A reniform suction chamber 4 and a reniform pressure chamber 5, essentially opposite radially, are located in the housing 1. The reniform suction chamber 4 includes a first end 15 and a second end 6. The reniform pressure chamber 5 includes a first end 16 and a second end 7. The distance between the second end 6 of the reniform suction chamber in a direction of transport 18 and an opposite beginning (i.e., second end 1) of the reniform pressure chamber 5 is one tooth pitch of the set of internal rotor gears located in the pump (not shown).

In the design according to the state of the art, the cover 8 of the pump shown in FIG. 2 has only the holes for fastening screws and drive shaft corresponding to the housing, but no reniform chambers to hold the oil to be transported.

Figure 4:
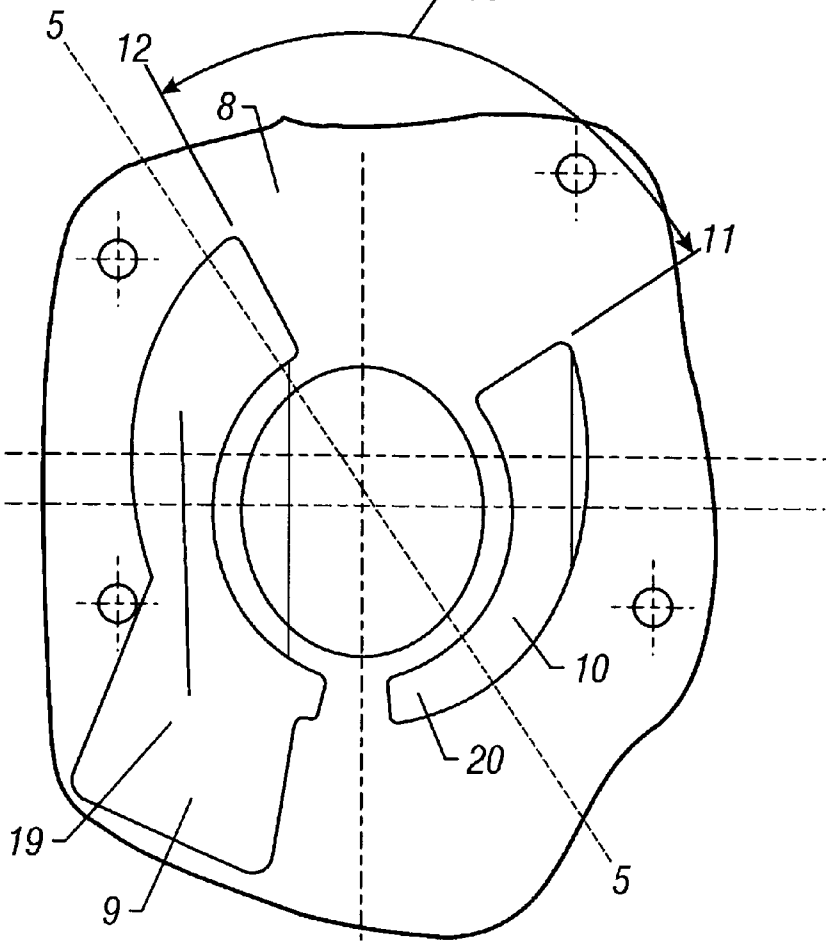
FIGS. 3 and 4 show the pump design of the invention, likewise in top view.
Figure 3:
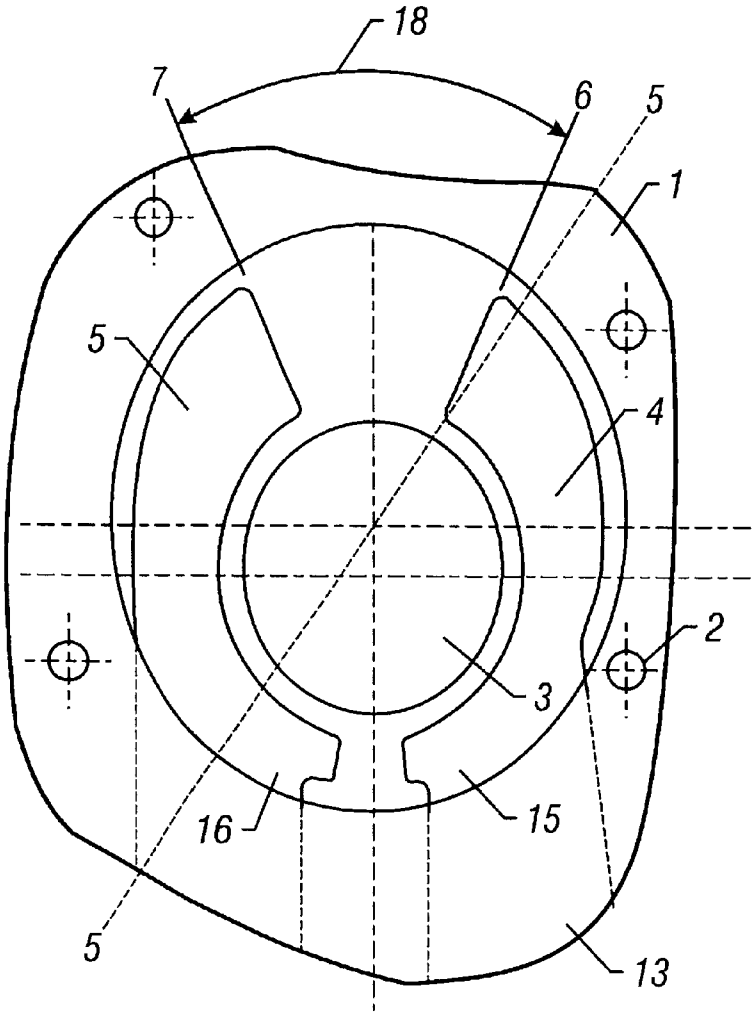
Figure 5:
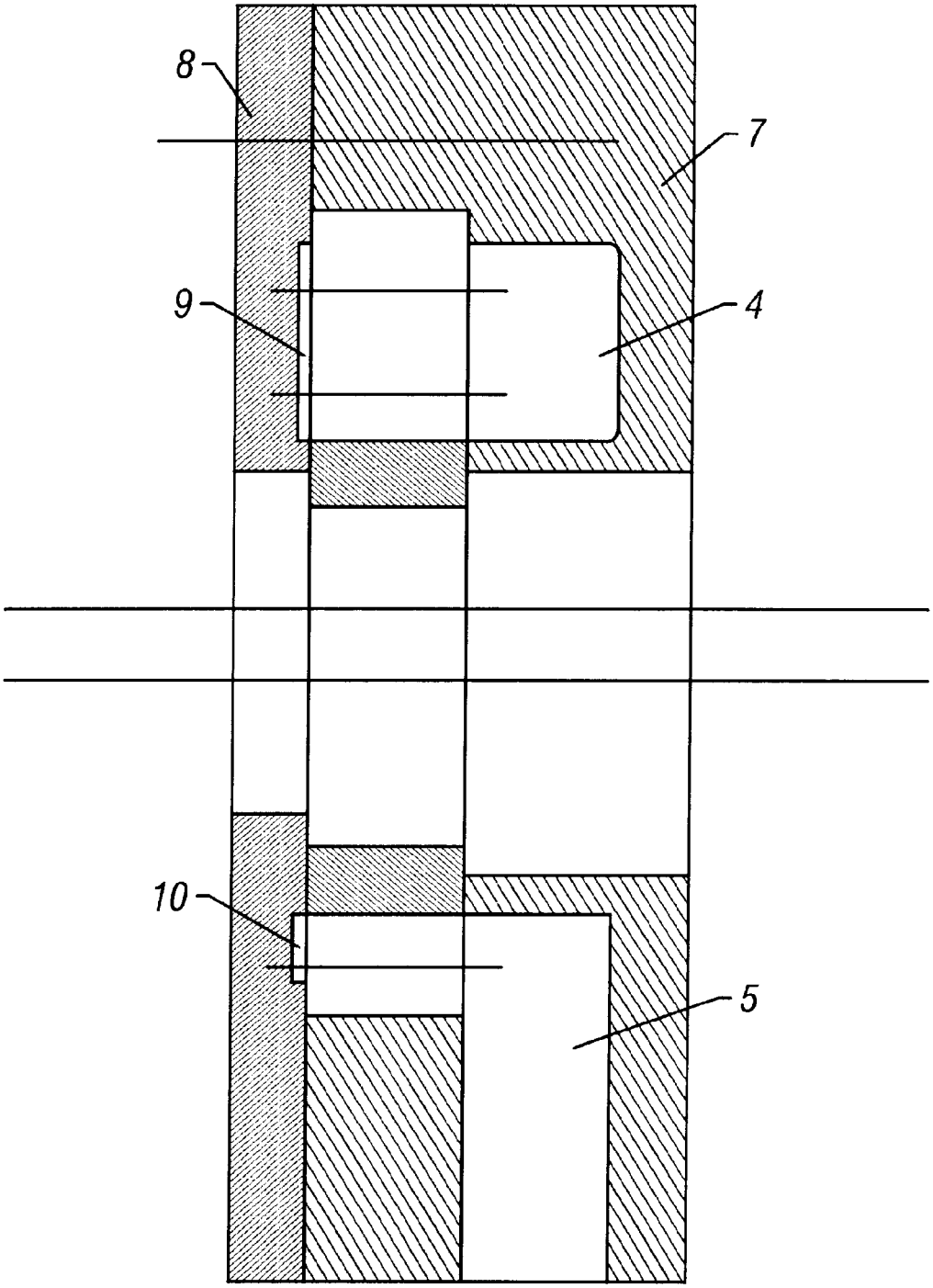
FIG. 5 shows the pump of the invention in cross section along the plane 5—5 in FIGS. 3 and 4.
Figure 6:
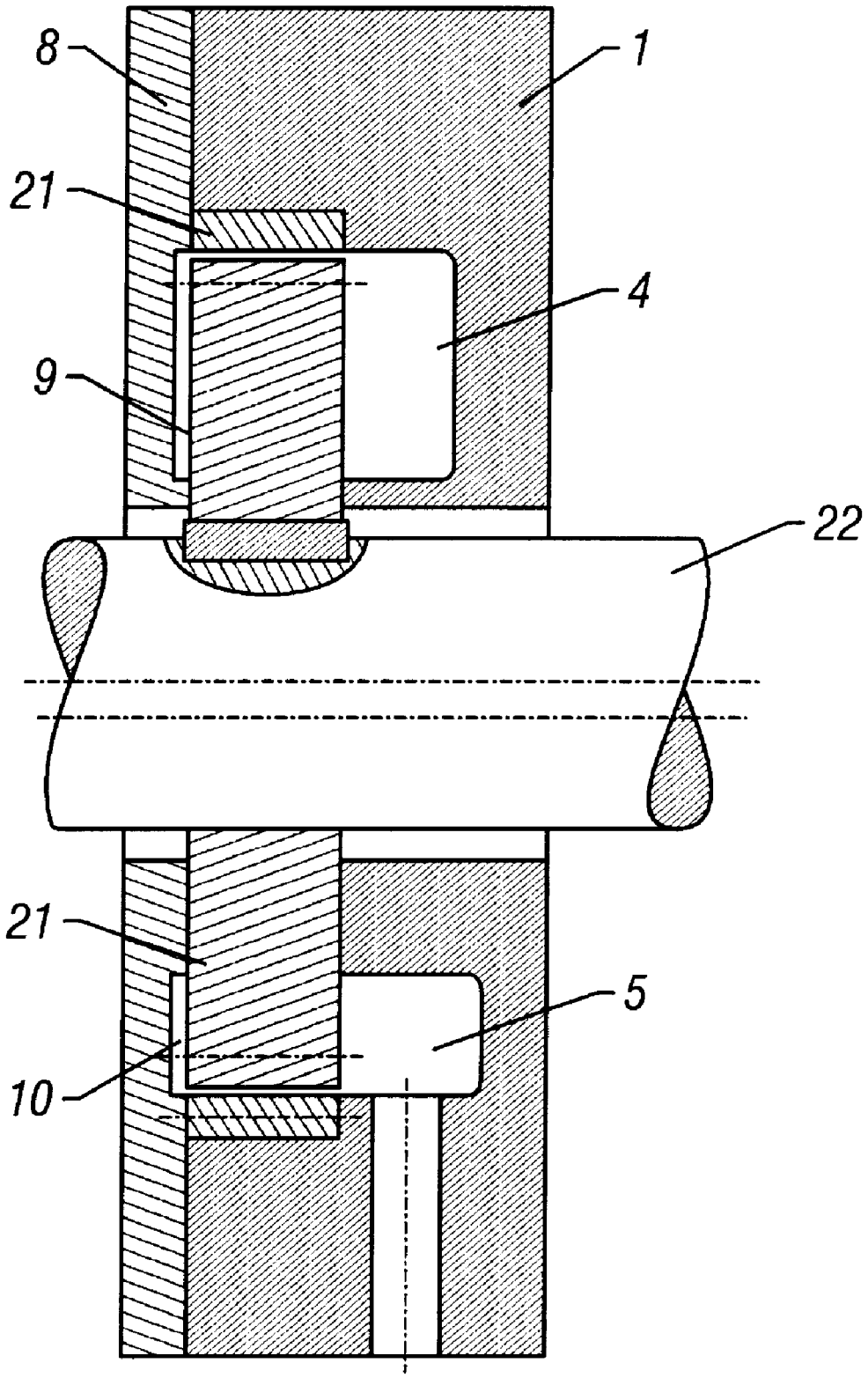
FIG. 6 is cross-sectional side view of the pump of FIG. 5 showing gear rotors and a central shaft.
Figure 8:
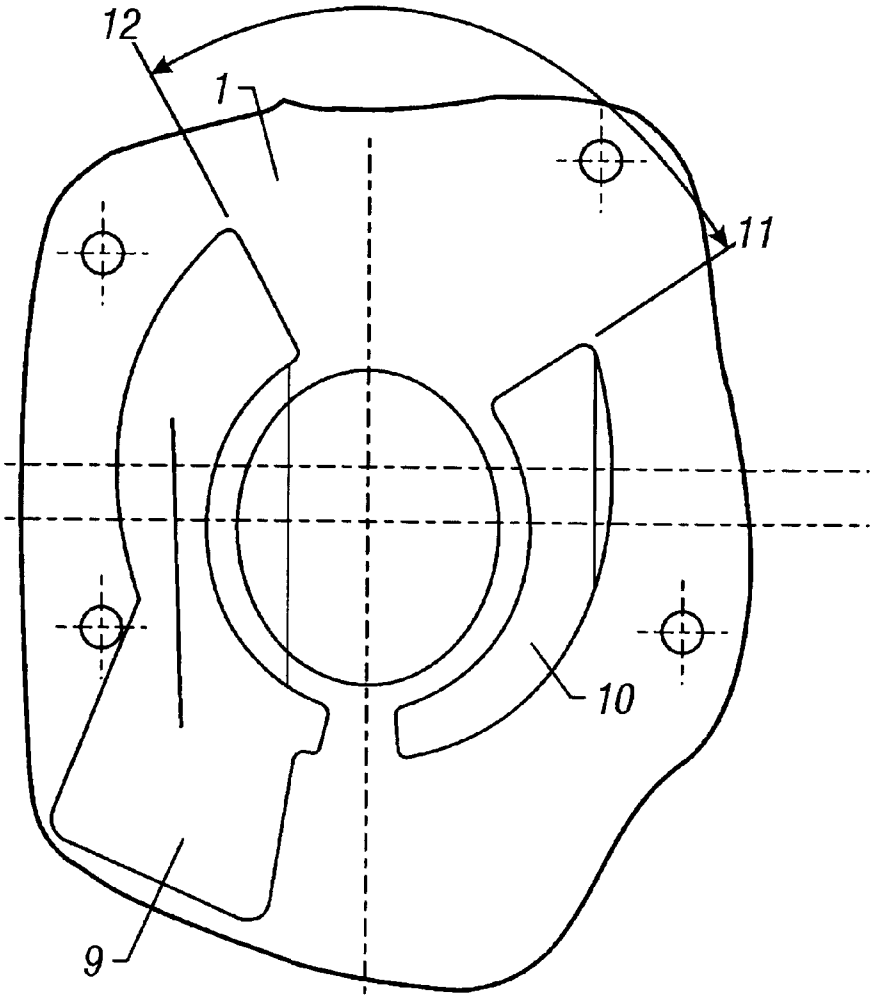
FIG. 8 is a top view of the housing showing the suction chamber extension and pressure chamber extension in the housing. The following reference symbols, and corresponding items, are used in the FIG. (1), pump housing; (2), hole for fastening screws; (3), central hole for drive shaft; (4), reniform suction chamber; (5), reniform pressure chamber; (6), second end of the reniform suction chamber; (7), second (i.e., the beginning) of the reniform pressure chamber; (8), cover; (9), reniform suction chamber extention; (10), reniform pressure chamber extention; (11), second end (i.e., the beginning) of the reniform pressure chamber extension; (12), second end (i.e., the end) of the reniform suction chamber extension; (13), infeed channel of the reniform suction chamber; (15), first end of the reniform suction chamber; (16), first end of the reniform pressure chamber; (18), direction of transport of the oil; (19), first end of the reniform suction chamber extension; (20), first end of the reniform pressure chamber extension; (21), gear rotor; and (22), central shaft.
Figure 7:
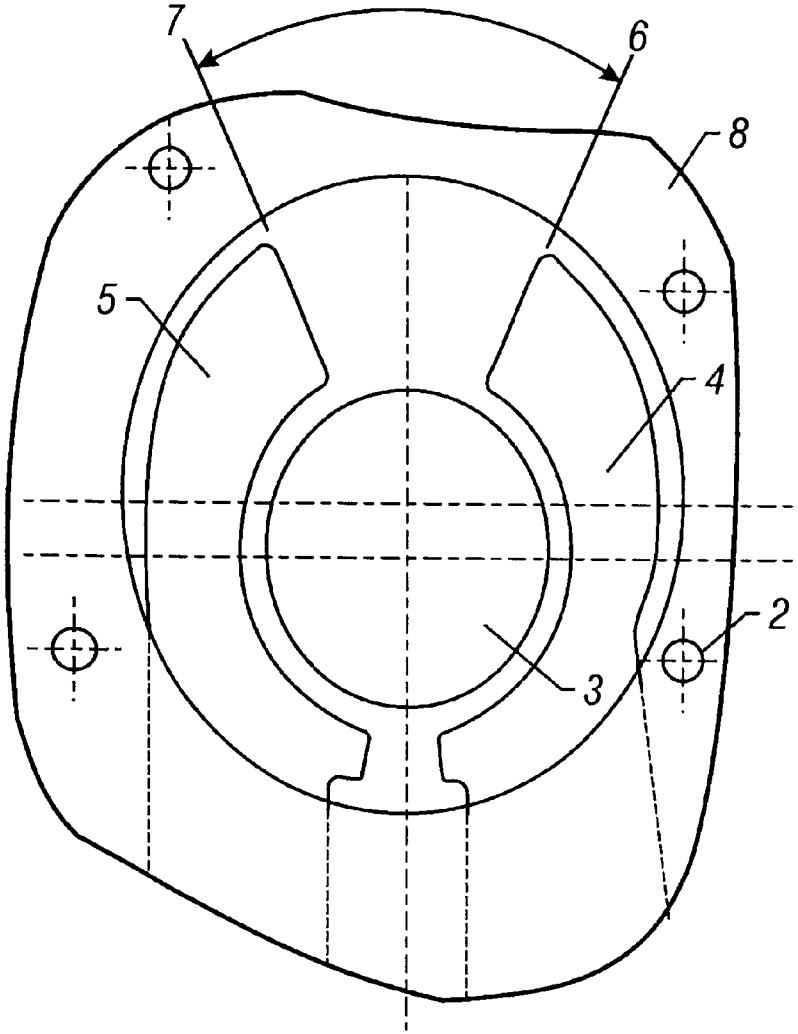
FIG. 7 is a top view of the cover showing the suction chamber and pressure chamber in the cover.

Figure 3 shows that no modifications are necessary in the housing region of the pump even when designed according to the invention. The design of the pump housing 1 is identical with that of the state of the art. The distance between the end 6 of the reniform such a chamber 4 and the beginning 7 of the reniform pressure chamber in this case also is one tooth pitch of the set of internal rotor gears. In the design of the cover 8 pursuant to the invention according to FIG. 4, there is a "dummy" reniform suction chamber extension 9 opposite the reniform suction chamber 4, and likewise a "dummy" reniform pressure chamber extension 10 opposite the reniform pressure chamber 5. The reniform suction chamber extension 9 includes a first end 19 and a second end 12. The reniform pressure chamber extension 10 includes a first end 20 and a second end 11. While the reniform suction chamber extension 9 has. Essentially the same contours as the opposite reniform suction chamber 4, and differs from it only by the fact that it lacks an opening opposite an infeed channel 13, the reniform pressure chamber extension 10 is limited in the area of the teeth of the set of internal rotor gears. The second and 11 of the (i.e. the beginning) reniform pressure chamber extension 10 in a direction of rotation is shortened by 0.5 to 1 tooth pitch of the set of internal rotor gears relative to the beginning 7 of the reniform pressure chamber 5 (see FIG. 3), so that the distance between the beginning 11 of the reniform pressure chamber extension 10 an end 12 of the reniform suction chamber extension 9 is 1.5 to 2 tooth pitches. The exact size of the distance between the two boundary lines is set as a function of the fluid to be pumped and the operating conditions of the pump so that cavitation is minimized and with it the noise level, pressure pulsation, and power consumption. FIGS. 5 and 6 show in cross-section through the pump embodiment pursuant to the invention along the plane 5—5 of FIGS. 3 and 4 the positioning of the gear rotors 21 and the central shaft 22, and the reniform suction chamber and reniform pressure chamber extensions 9 and 10, respectively, in the cover 8 of the pump. As noted above, when cover 8 is placed against pump housing 1, reniform suction chamber extension 9 is opposite reniform suction chamber 4 and reniform pressure chamber extension 10 is opposite reniform pressure chamber 5. At the same time, it can be seen that the reniform pressure chamber extension in the outflow area covers only a portion of the transport chamber between the teeth of the set of internal rotor gears and that the reniform suction and pressure chamber extensions 9 and 10 respectively have smaller depths than the reniform suction and pressure chamber 4 and 5 respectively. These can also be varied for optimization, depending on the operating characteristics of the pump.

As stated previously, it is not necessary in all cases to arrange for the reniform suction chamber extension 9 when using appropriate pumps. With pumps that run al lower speeds, a reniform suction chamber extension can be omitted.

What is claimed is:

1. A gear pump with internal rotors for pumping fluids, the gear pump comprising:

one or more internal gear rotors located in a pump housing and driven by a central shaft, each gear rotor including teeth;

a cover to seal the pump housing, the cover being adjacent to the one or more internal gear rotors;

at least one infeed reniform suction chamber in the pump housing, each infeed reniform suction chamber having a first end and a second end, and at least partially covering end areas of the teeth of the internal gear rotors;

at least one discharge reniform pressure chamber in the pump housing, each discharge reniform pressure chamber having a first end and a second end, and at least partially covering the end areas of the teeth of the internal gear rotors; and a reniform pressure chamber extension having a first end and a second end and located in the cover opposite the discharge reniform pressure chamber, wherein the first end of the discharge reniform pressure chamber is substantially adjacent to the first end of the reniform pressure chamber extension and a radial distance between the first and second ends of the reniform pressure chamber extension is less than a radial distance between the first and second ends of the discharge reniform pressure chamber.

2. The gear pump of claim 1, wherein the reniform pressure chamber extension covers the teeth of the internal gear rotors to a lesser extent than does the discharge reniform pressure chamber.

3. The gear pump of claim 1, wherein the reniform pressure chamber extension is tapered such that a width of the first end is narrower than a width of the second end.

4. The gear pump of claim 1, further comprising a reniform suction chamber extension having a first end and a second end and located in the cover opposite the infeed reniform suction chamber, wherein the first end of the infeed reniform suction chamber is substantially adjacent to the first end of the reniform suction chamber extension, and the second end of the infeed reniform suction chamber is substantially adjacent to the second end of the reniform suction chamber extension.

5. The gear pump of claim 4, wherein the distance between the second end of the reniform suction chamber extension and the second end of the reniform pressure chamber extension is greater than the distance between the second end of the infeed reniform suction chamber and the second end of the discharge reniform pressure chamber by a length of 0.5 to 1 times the tooth pitch of the internal gear rotors.

6. A gear pump with internal rotors for pumping fluids, the gear pump comprising:

one or more internal gear rotors located in a pump housing and driven by a central shaft, each gear rotor including teeth;

a cover to seal the pump housing, the cover being adjacent to the one or more internal gear rotors;

at least one infeed reniform suction chamber in the pump housing, each infeed reniform suction chamber having a first end and a second end, and at least partially covering end areas of the teeth of the internal gear rotors;

at least one discharge reniform pressure chamber in the pump housing, each discharge reniform pressure chamber having a first end and a second end, and at least partially covering the end areas of the teeth of the internal gear rotors; and a reniform pressure chamber extension having a first end and a second end and located in the cover opposite the discharge reniform pressure chamber, wherein the reniform pressure chamber extension covers the teeth of the internal gear rotors to a lesser extent than does the discharge reniform pressure chamber.

7. The gear pump of claim 6, wherein the reniform pressure chamber extension is tapered such that a width of the first end is narrower than a width of the second end.

8. The gear pump of claim 6, further comprising a reniform suction chamber extension having a first end and a second end and located in the cover opposite the infeed reniform suction chamber, wherein the first end of the infeed reniform suction chamber is substantially adjacent to the first end of the reniform suction chamber extension, and the second end of the infeed reniform suction chamber is substantially adjacent to the second end of the reniform suction chamber extension.

9. The gear pump of claim 8, wherein the distance between the second end of the reniform suction chamber extension and the second end of the reniform pressure chamber extension is greater than the distance between the second end of the infeed reniform suction chamber and the second end of the discharge reniform pressure chamber by a length of 0.5 to 1 times the tooth pitch of the internal gear rotors.

10. A gear pump with internal rotors for pumping fluids, the gear pump comprising:

one or more internal gear rotors located in a pump housing and driven by a central shaft, each gear rotor including teeth;

a cover to seal the pump housing, the cover being adjacent to the one or more internal gear rotors;

at least one infeed reniform suction chamber in the cover, each infeed reniform suction chamber having a first end and a second end, and at least partially covering end areas of the teeth of the internal gear rotors;

at least one discharge reniform pressure chamber in the cover, each discharge reniform pressure chamber having a first end and a second end, and at least partially covering the end areas of the teeth of the internal gear rotors; and a reniform pressure chamber extension having a first end and a second end and located in the pump housing opposite the discharge reniform pressure chamber, wherein the first end of the discharge reniform pressure chamber is substantially adjacent to the first end of the reniform pressure chamber extension and a radial distance between the first and second ends of the reniform pressure chamber extension is less than a radial distance between the first and second ends of the discharge reniform pressure chamber.

11. The gear pump of claim 10, wherein the reniform pressure chamber extension covers the teeth of the internal gear rotors to a lesser extent than does the discharge reniform pressure chamber.

12. The gear pump of claim 10, wherein the reniform pressure chamber extension is tapered such that a width of the first end is narrower than a width of the second end.

13. The gear pump of claim 10, further comprising a reniform suction chamber extension having a first end and a second end and located in the pump housing opposite the infeed reniform suction chamber, wherein the first end of the infeed reniform suction chamber is substantially adjacent to the first end of the reniform suction chamber extension, and the second end of the infeed reniform suction chamber is substantially adjacent to the second end of the reniform suction chamber extension.

14. The gear pump of claim 1, wherein the distance between the second end of the reniform suction chamber extension and the second end of the reniform pressure chamber extension is greater than the distance between the second end of the infeed reniform suction chamber and the second end of the discharge reniform pressure chamber by a length of 0.5 to 1 times the tooth pitch of the internal gear rotors.

15. A gear pump with internal rotors for pumping fluids, the gear pump comprising:

one or more internal gear rotors located in a pump housing and driven by a central shaft, each gear rotor including teeth;

a cover to seal the pump housing, the cover being adjacent to the one or more internal gear rotors;

at least one infeed reniform suction chamber in the cover, each infeed reniform suction chamber having a first end and a second end, and at least partially covering end areas of the teeth of the internal gear rotors;

at least one discharge reniform pressure chamber in the cover, each discharge reniform pressure chamber having a first end and a second end, and at least partially covering the end areas of the teeth of the internal gear rotors; and a reniform pressure chamber extension having a first end and a second end and located in the pump housing opposite the discharge reniform pressure chamber, wherein the reniform pressure chamber extension covers the teeth of the internal gear rotors to a lesser extent than does the discharge reniform pressure chamber.

16. The gear pump of claim 15, wherein the reniform pressure chamber extension is tapered such that a width of the first end is narrower than a width of the second end.

17. The gear pump of claim 15, further comprising a reniform suction chamber extension having a first end and a second end and located in the pump housing opposite the infeed reniform suction chamber, wherein the first end of the infeed reniform suction chamber is substantially adjacent to the first end of the reniform suction chamber extension, and the second end of the infeed reniform suction chamber is substantially adjacent to the second end of the reniform suction chamber extension.

18. The gear pump of claim 17, wherein the distance between the second end of the reniform suction chamber extension and the second end of the reniform pressure chamber extension is greater than the distance between the second end of the infeed reniform suction chamber and the second end of the discharge reniform pressure chamber by a length of 0.5 to 1 times the tooth pitch of the internal gear rotors.

* * * * *